US005107561A

United States Patent [19]

Hüther

[11] Patent Number: 5,107,561

[45] Date of Patent: Apr. 28, 1992

[54] BRIDGE LAYING DEVICE

[75] Inventor: Herbert Hüther, Wangen, Fed. Rep. of Germany

[73] Assignee: Dornier GmbH, Fed. Rep. of Germany

[21] Appl. No.: 674,898

[22] Filed: Mar. 26, 1991

[30] Foreign Application Priority Data

Mar. 26, 1990 [DE] Fed. Rep. of Germany ..... 4009639

[51] Int. Cl.[5] ..... E01D 15/12

[52] U.S. Cl. ..... 14/2.4

[58] Field of Search ..... 14/2.4, 1

[56] References Cited

U.S. PATENT DOCUMENTS

| | | | |
|---|---|---|---|
| 3,820,181 | 6/1974 | Wagner et al. | 14/2.4 |
| 4,023,226 | 5/1977 | Soffge et al. | 14/2.4 |
| 4,288,881 | 9/1981 | Mahncke et al. | 14/2.4 |

FOREIGN PATENT DOCUMENTS

| | | | |
|---|---|---|---|
| 0093873 | 4/1983 | European Pat. Off. . | |
| 2166757 | 11/1975 | Fed. Rep. of Germany | 14/2.4 |
| 2926594 | 1/1981 | Fed. Rep. of Germany . | |
| 3038702 | 4/1982 | Fed. Rep. of Germany . | |
| 3038702 | 4/1982 | Fed. Rep. of Germany . | |
| 3335482 | 4/1985 | Fed. Rep. of Germany | 14/2.4 |
| 3433178 | 1/1986 | Fed. Rep. of Germany . | |
| 3535640 | 4/1987 | Fed. Rep. of Germany | 14/2.4 |
| 3814502 | 11/1989 | Fed. Rep. of Germany . | |
| 2186614 | 8/1987 | United Kingdom | 14/2.4 |

*Primary Examiner*—William P. Neuder

*Attorney, Agent, or Firm*—Evenson, Wands, Edwards, Lenahan & McKeown

[57] ABSTRACT

A laying vehicle for a bridge composed of connectable bridge elements includes a laying beam and a carriage that can be moved on the laying beam and having a swivelling elevating platform on which the bridge elements are disposed. A holding device for the locking of the connected bridge elements is provided on the laying beam. The carriage lifts the whole bridge off the laying beam and moves it, therefore, the bridge does not require rollers or rails for its displacement.

5 Claims, 9 Drawing Sheets

FIG. 7A
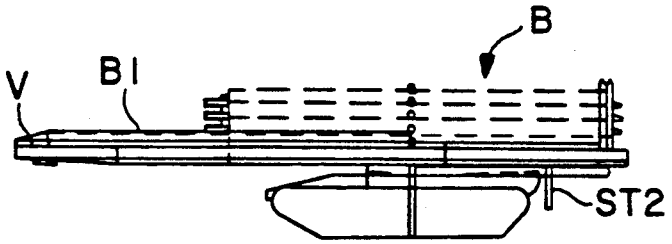
FIG. 7B
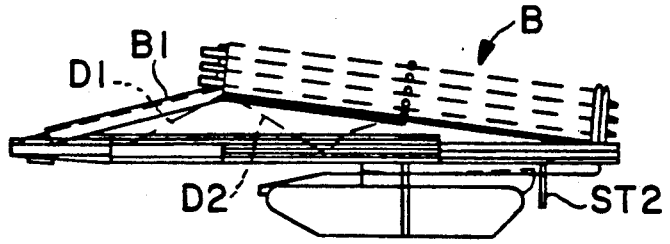
FIG. 7C
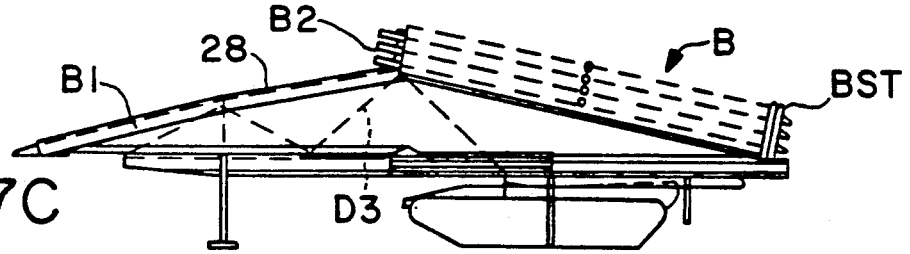
FIG. 7D
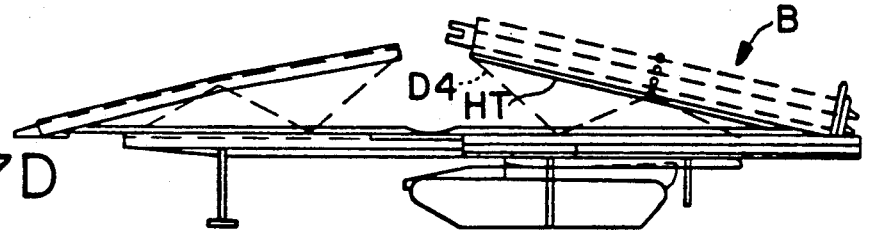
FIG. 7E
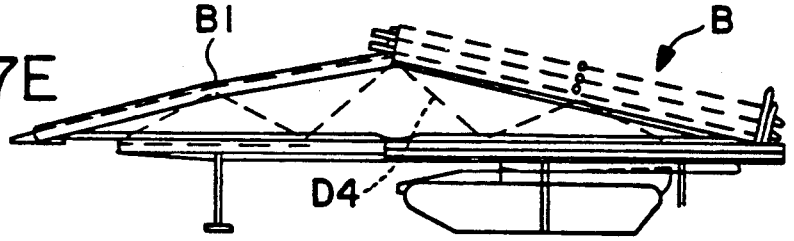
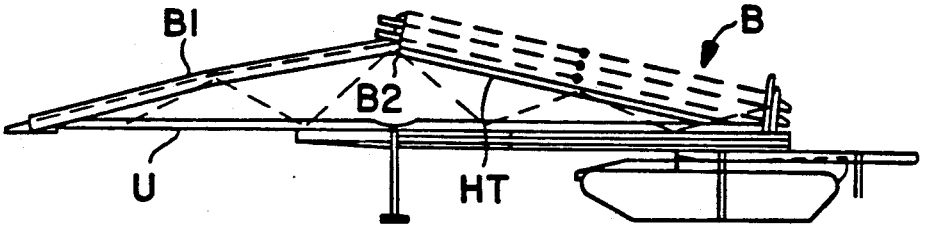
FIG. 7F

BRIDGE LAYING DEVICE

BACKGROUND AND SUMMARY OF THE INVENTION

This invention relates to a laying device for a bridge composed of connectable bridge elements and, more particularly, to a laying device having an extendable and swivelling laying beam and a carriage movable on the laying beam including a swivable elevating platform. The bridge elements are disposed on the platform A known laying vehicle for a bridge composed of connectable bridge elements is described in German Patent Document DE-OS 38 14 502. The laying vehicle includes a laying beam which can be moved out and swivelled, a carriage which can be moved on the laying beam, and an elevating platform on which the bridge elements are disposed. In this case, the bridge elements are moved into their intended shape by the elevating platform, are connected to the previously erected bridge elements, and are displaced on the laying beam over the obstacle. The precise details are not indicated in this case.

German Patent Document DE-OS 29 26 594 describes a bridge laying vehicle having a longitudinally displaceable bridge carrier by means of which the bridge can be displaced toward the front and toward the rear, thereby changing the axle load of the vehicle.

There is currently needed a laying device which can lay longer bridges without requiring any front-part carrying device.

The present invention meets this need by providing a laying device having a laying beam which is extendable and swivellable. A carriage is movably mounted on the laying beam and includes a swivelling elevating platform on which the connectable bridge elements are disposed. A first holding device provided on the laying beam locks previously connected bridge elements A second holding device provided on the carriage locks a next connectable bridge element to be laid wherein the carriage lifts and moves the whole constructed bridge off of the laying beam.

A laying device according to an embodiment of the present invention has an elevating platform that is swivelled with respect to the carriage around an axis in the rearward area of the platform and carriage The laying device further comprises a supporting system which is swivellable and extendable arranged on the laying beam.

In another advantageous embodiment of the present invention, the elevating platform includes a horizontally extending joint such that when the platform is lifted, its forward part is brought into a horizontal position According to the present invention, a travelling carriage is provided which rolls on the laying beam. The travelling carriage has an elevating platform which can hold the bridge, move it forward toward the next connecting point and deposit it on the laying beam. The carriage can then connect the next bridge part. The completed parts of the bridge or the whole bridge can be lifted and moved toward the front to a depositing site. As a result of the elevating platform according to the present invention, rollers or rails are not required either on the bridge or for guiding the bridge on the laying beam.

As a result, all of the elements normally required for moving the bridge (such as rollers, rails, drives, etc.) are no longer part of the bridge but are integrated into the laying system. This has a very favorable effect on the required standing moment because the bridge may now have a lighter design.

It is an advantage of the laying device according to the present invention that it is possible to lay different types of bridges with only slight changes. Because rollers or rails for the bridge are not required, the bridges must not be specifically adapted to the laying vehicle. It is therefore possible to assemble and lay different types of bridges having larger lengths.

The laying device according to the present invention makes it possible to unfold, assemble, and lay a bridge that can be varied in its height, such as the telescopic truss bridge described in German Patent Document DE-OS 38 14 502. In this case, the substructure of the bridge is held on the carriage, and the bridge floor pieces are moved to the required height with a length measuring system by means of hydraulic cylinders of the elevating platform. The telescopic diagonal braces are pulled apart and are subsequently locked from the elevating platform.

The construction in which the carriage and the elevating platform have a common swivelling axis in their rearward area, such as a fixed hinge on the rear edges of both structural members, is particularly simple and stable. In this embodiment, the elevating platform can be swivelled with respect to the carriage by means of, for example, two hydraulic cylinders. For example, the platform can be swivelled approximately fifteen degrees (15°).

In another embodiment of the invention, a supporting system, provided on the swivelling laying beam, can be swivelled and moved out with respect to the laying beam. By means of the moving-out of the long laying beam with the supporting system in the front, the standing moment can be significantly increased by the large lever arm without the requirement of increasing the weight of the vehicle because the vehicle now acts as a balance weight. Since the weight of the bridge is reduced because the normal rollers or rails on the bridge are eliminated, the standing moment is further increased, resulting in the capability of laying longer bridges It is advantageous that the present invention generates a high standing moment of the laying device without increasing the weight of the laying device; reduces the weight of the bridge by transferring the bridge displacement devices and the bridge erecting devices from the bridge to the laying system; and allows for the laying of a forty meter bridge (such as a telescopic truss bridge) with a dead weight of approximately fourteen tons composed of four segments (equalling eight bridge elements). In this case, the bridge may be transported on one vehicle and, from that one vehicle, may be unfolded, assembled and laid to different heights. It is also possible to lay the four segments individually as shorter bridges or to lay, for example, two segments as a longer bridge and the two other segments as individual bridges.

Since, in the case of this laying device, all active elements are integrated into the laying system, the laying operation can be efficiently automated.

Other objects, advantages and novel features of the present invention will become apparent from the following detailed description of the invention when considered in conjunction with the accompanying drawings.

BRIEF DESCRIPTION OF THE DRAWINGS

FIGS. 7A-7J are conservative views of a laying operation of a 40 m bridge;

DETAILED DESCRIPTION OF THE DRAWINGS

Figure 1:
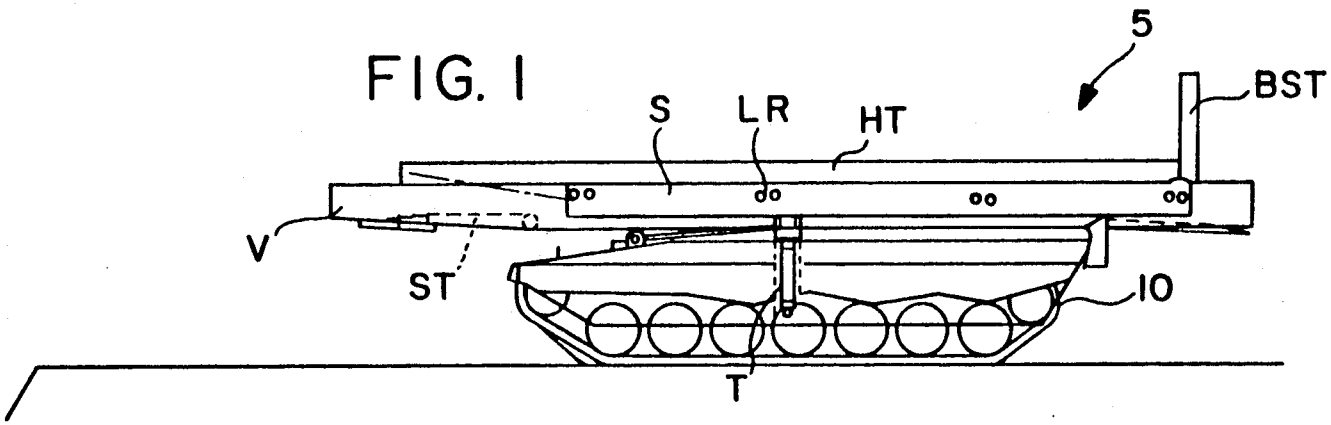
FIG. 1 is a side view of a laying device in a transport position.

FIG. 1 illustrates a laying device or laying vehicle 5 according to the invention in the transport position. It shows the elevating platform HT, the carriage S, the laying beam V, the supporting system ST, the runners LR of the carriage S, and the bridge stacking device BST on the elevating platform HT. The laying beam V is fastened to the vehicle using a telescopic support in such a manner that it can be moved to the front and/or swivelled downward toward the front of the laying vehicle 5.

Figure 2:
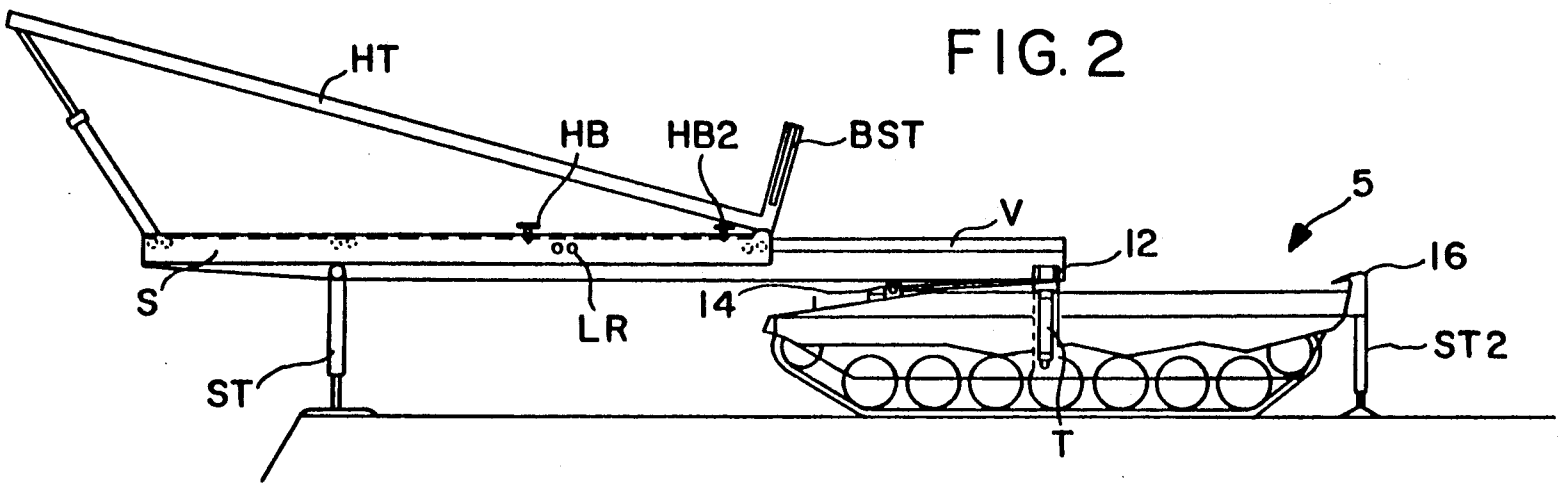
FIG. 2 is a side view of a laying device in an operating position.

FIG. 2 illustrates the laying device according to FIG. 1 in the operating position without any bridge segments, i.e. bridge parts. It is an independent system which in this case, energetically and by way of four mechanical fixed points, is connected with a tank 10 as part of the laying vehicle 5. The laying system essentially includes the laying beam V, the supporting system ST, the carrige S, and the elevating platform HT.

The laying beam V is connected with the tank 10 and carries out the functions of: (1) being a lever arm for generating a high standing moment; (2) being a carrier for the carriage S with the elevating platform HT; (3) being a depositing device for finished bridge segments; and (4) being a swivel arm for the depositing and picking-up of the bridges or compensating for different embankment heights.

In this case, the laying beam V consists of a pair of welded metal-section carriers or beams, for example, aluminum, which in its forward part, are connected with one anotehr by way of a torsion-proof truss structure (not shown).

The forward hydraulic supporting system ST is also situated in the forward part of the laying beam V and is hinged thereto. In the rearward area of the tank 10, the pair of beams is connected with the tank by way of a roller guide. The roller guide includes a pair of rollers 12 arranged approximately in the center of the tank that can be lifted by means of a hydraulic cylinder, e.g. telescope T, and another pair of rollers 14 in the forward tank area that is fixedly connected with the chassis. Thus, a swivelling capability is achieved while an interaction takes place with the forward supporting system ST.

The laying beam V is moved into the extended position shown in FIG. 2 only for bridge construction. For transport conditions, the laying beam system can be moved back over the tank 10 until it is approximately centered. A pair of rollers 16 in the proximity of the rear supporting system is intended to receive the laying beam V in a transport position. Hydraulically driven pairs of cable winches with prestressed cables (not shown) may be provided, for example, as the driving device for moving the system into its two positions.

In this case, embedded in the laying beam V in a protected manner are the hydraulic lines, the power supply for the valves, the sensory analysis system of the two forward supporting cylinders along with their swivel actuators as well as the hydraulic motors of the cable winches. The supply lines in the laying beam V are flexibly connected with the tank 10. It is possible to use energy drag chains or a hose reel with a hydraulic motor.

In FIG. 2, the laying beam V is moved completely toward the front of the tank 10, and the supporting system ST is swivelled out from the beam V into an operative position. The carriage S is situated in the forward position. The elevating platform HT is maximally swivelled upward with respect to the carriage S. Also shown in FIG. 2 is the holding device HB for the bridge. The holding device HB locks already connected bridge elements on the laying beam V. A second holding device HB2 locks the bottom chords of the bridge elements or the whole bridge elements on the carriage S.

Figure 3B:
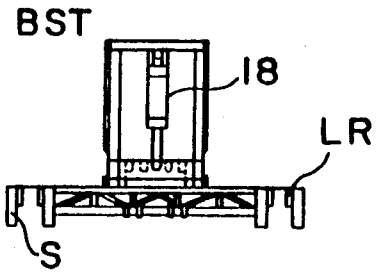
FIGS. 3A, 3B and 3C are side, front and top views, respectively, of a carriage with an elevating platform.
Figure 3A:
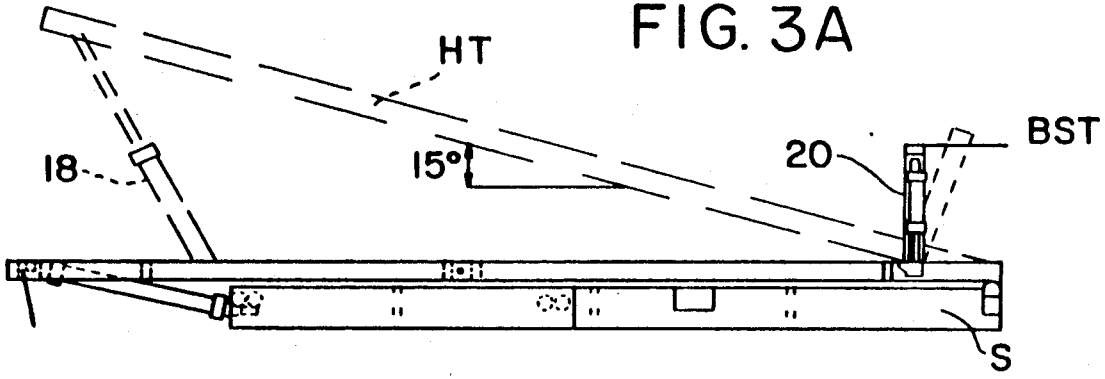
Figure 3C:
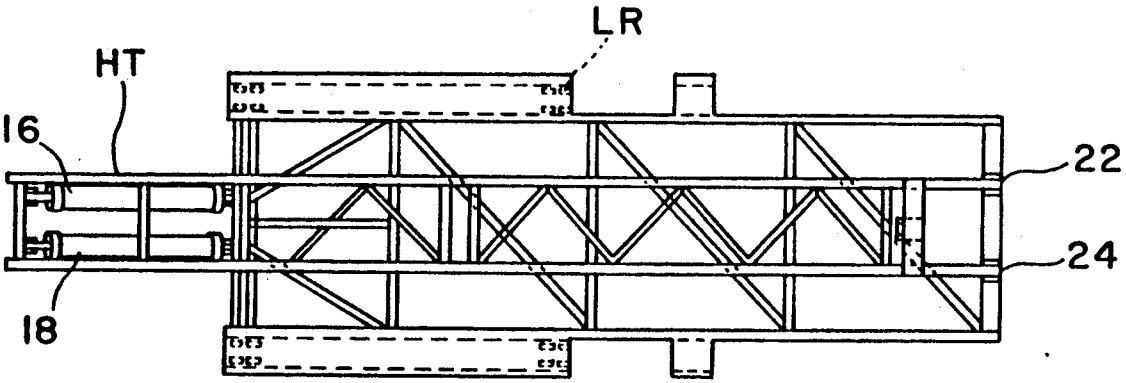

FIGS. 3A-3C are different views of an embodiment of carriage S, where the elevating platform HT can be swivelled by means of two hydraulic telescopes 16, 18 (FIG. 3C), only one of which is shown in FIGS. 3A and 3B. The axis of rotation of the elevating platform HT on the carriage S is situated in the rearward area of the carriage S and the elevating platform HT. On the bridge stacking device BST, a telescopic cylinder 20 is shown which is used for the lifting of the bridge stack and for the securing of the transport.

In FIGS. 3B and 3C, the runners LR of the carriage S are shown by means of which the carriage S can be displaced on the laying beam V. In this case, two sets of runners respectively are provided on each side; in the case of the embodiment shown in FIG. 2, there are four sets of rollers respectively for each side. The carriage S and the elevating platform HT are designed in the truss frame construction as light-metal structure as seen in FIG. 3C.

The carriage S is used for the transport of the bridge parts in the longitudinal direction toward the rear on the laying beam V. This lengthens the bridge construction plane in the rearward direction. As a result, no separate rollers are required for the bridge. The carriage S is guided on correspondingly constructed rails SS (FIG. 4B) of the laying beam V. For this purpose, sturdy sets of runners LR are housed in a rigid U-section on both sides of the carriage frame as shown in FIG. 3B. This section must also absorb the moments of the bridge when it is laid.

In this case, the elevating platform HT is hinged to the laying carriage S at four points. The rear joint of the elevating platform HT on the carriage frame comprises two fixed hinges 22, 24. On the forward part of the carriage S, the elevating platform HT, by way of two hydraulic cylinders 18, 20, is connected with the carriage frame. These are used for the erecting of the bridge segments and the lifting-up of the bridge. For the laying or picking-up again, the bridge segments rest on the elevating platform HT in the form of stacks. The lower segment of the stack is therefore erected or folded together. The lowest segment must be pulled out of the bridge stack for the erecting. To do this, the remaining bridge stack is lifted up. This is carried out by the bridge stacking unit BST rigidly connected with the elevating platform HT. On the frame of the bridge stacking unit BST, a hydraulic cylinder 20 is pivoted which lifts up the remaining bridge stack in a pulling manner. Another function of the bridge stacking unit BST is to anchor the bridge stack during transport or to use the bridge stacking unit as the fixed point of the remaining bridge stack during the laying operation.

All drives (not shown), which are required for the erecting and locking of the elements are disposed on the carriage S and on the elevating platform HT. A purely hydraulic driving concept is possible.

The power supply (not shown) of the carriage S and of the elevating platform HT may be completely separate from that of the laying beam V. The power supply from the vehicle to the carriage, as described in the case of the laying beam V, may also be implemented here by way of a hose pipe. The distribution to the consuming device will then take place from the carriage S.

Figure 4D:
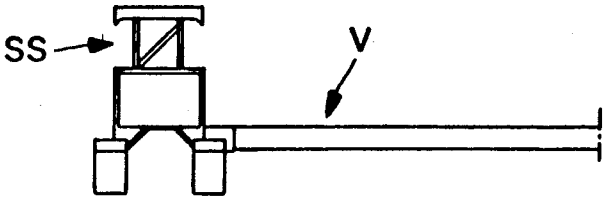
FIGS. 4D and 4E are an end view taken in the direction of Y in FIG. 4A and a cross-sectional view taken along line B—B in FIG. 4B, respectively.
Figure 4E:
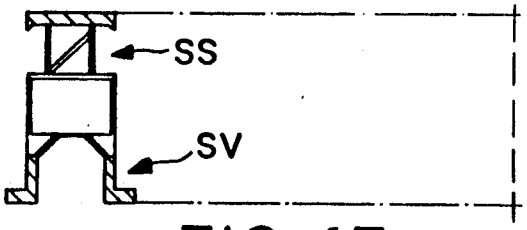
Figure 4C:
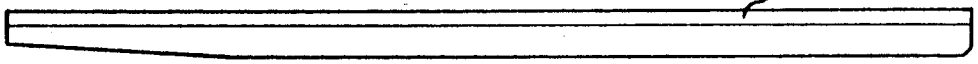
FIGS. 4B and 4C are side views in the direction of X and line A—A in FIG. 4A, respectively.
Figure 4B:
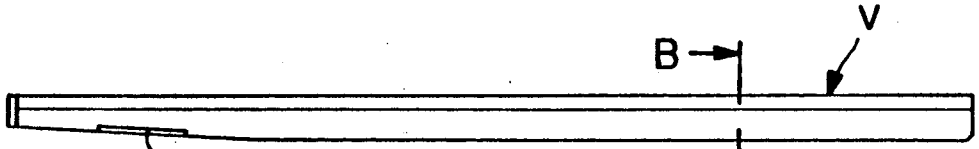
Figure 4A:
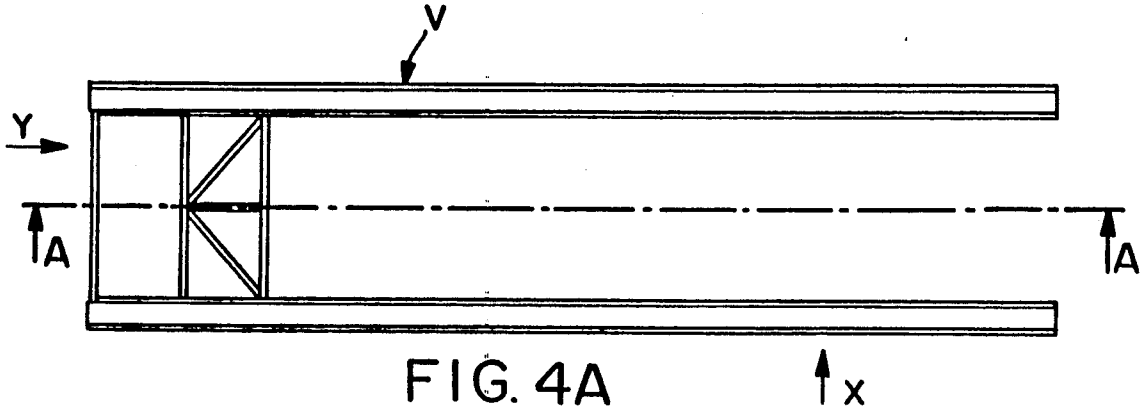
FIG. 4A is a top view of a laying beam.

FIGS. 4A–4E illustrate views of an embodiment of a laying beam V. The rails SS for the runners LR of the carriage S are shown in FIGS. 4D and 4E. In FIG. 4A, the rests and the rails SV for the rollers 12, 14 fixed to the vehicle 10 are shown on the vehicle chassis and on the telescope T (FIG. 5).

Figure 5A:
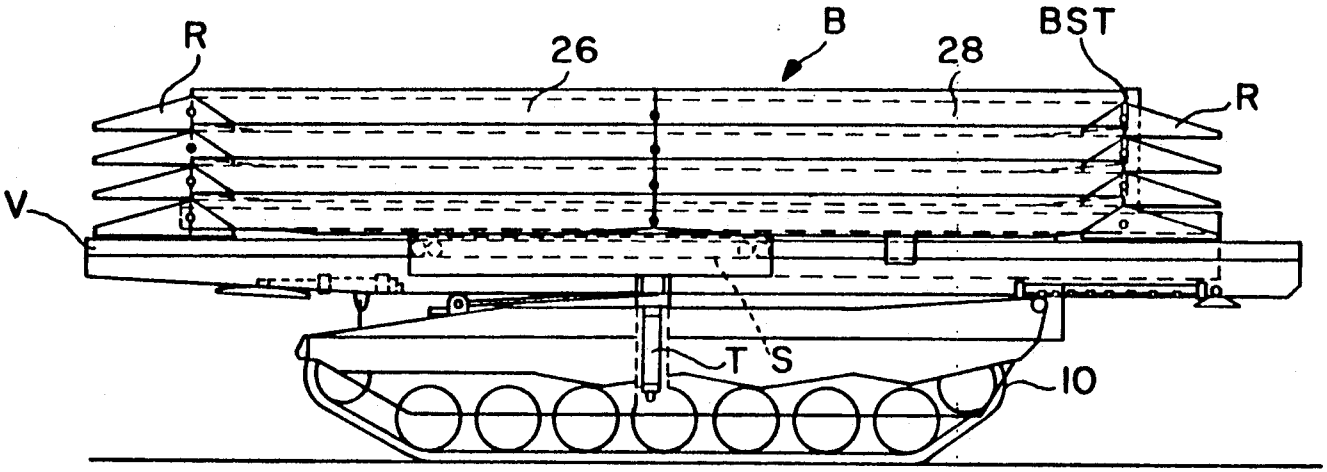
FIGS. 5A and 5B are side and front views of a laying device with the vehicle and four bridge segments.
Figure 5B:
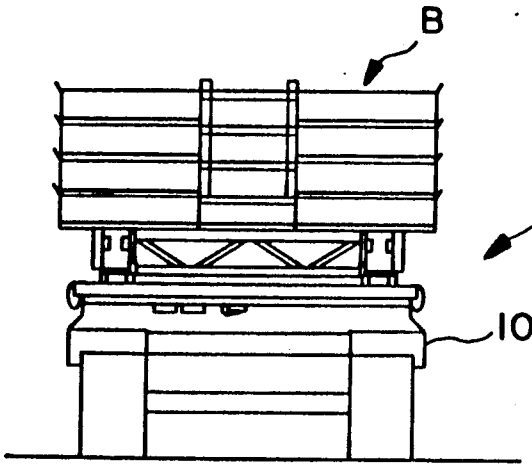

FIGS. 5A and 5B illustrate a laying device 5, which is loaded with four 10 m bridge segments B, for the laying of bridges having bridgespans between ten and forty meters. The bridges correspond to the bridges described in the German Patent Document DE-OS 38 14 502. It is shown that the bridge segments B each comprise two bridge elements 26, 28 which are rotatably connected with one another. At one of their ends, the bridge segments B are anchored in the bridge stacking device BST. Ramp parts R are fastened on both sides of the bridge segments B. The laying beam V, by way of a first set of rollers, is displaceably disposed in the forward part of the vehicle 10 and, by way of a second set of rollers, is displaceably disposed in the rearward area of the vehicle 10. The laying beam's slope may be adjusted by the telescope T in the vehicle center. Rollers are used for this purpose which are fastened on the telescope T and engage in rails SV of the laying beam V shown in FIG. 4.

Figure 6A:
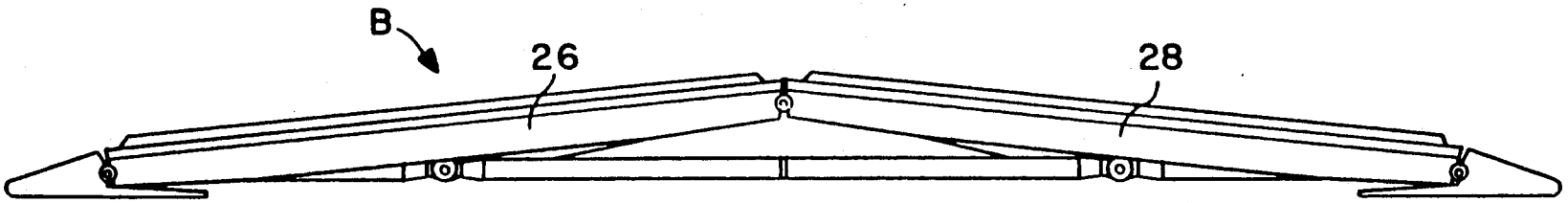
FIGS. 6A and 6B are views of a bridge segment.
Figure 6B:
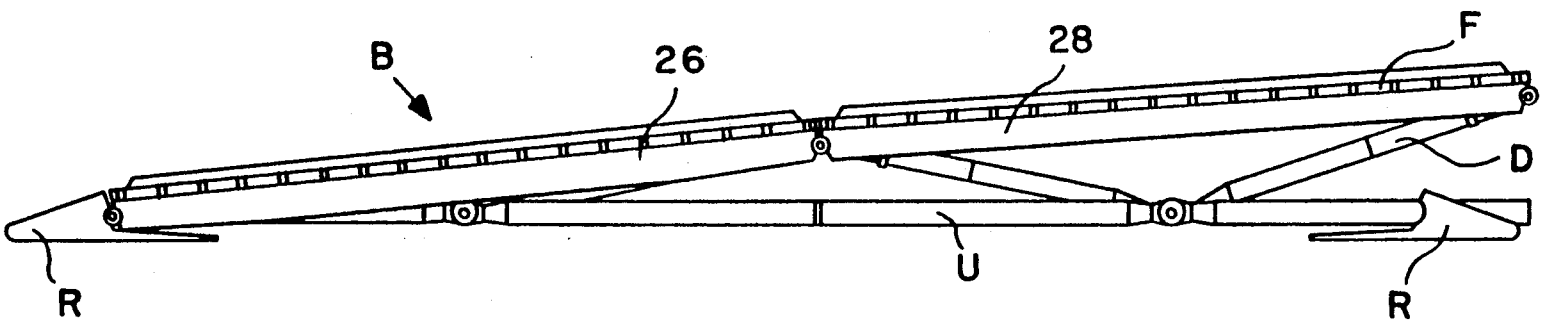

FIGS. 6A and 6B illustrate first and second bridge segments B, respectively, composed of two bridge elements 26, 28. In FIG. 6A the bridge segment B is shaped as a short ten meter bridge. In FIG. 6B bridge segment B forms a part, i.e., a ramp part, of a longer bridge (remainder not shown). The bridge elements 26, 28 each comprise the bridge floor parts F, the telescopable diagonal braces D, the extendable or shortenable bottom chords U and the ramps R. The left ramp R is shown in the working position, i.e., as a ramp; the right ramp R in FIG. 6B is displaced toward the rear in the connecting position so that the corresponding bottom chord U can be connected with the bottom chord U of the next bridge segment.

FIGS. 7A–7J show ten main steps of a laying operation of a forty meter bridge with a laying device 5 according to the present invention. The steps indicate the following described by Figure:

FIG. 7A—The laying beam V is advanced with the forward supporting system ST and the lower first bridge segment B1.

FIG. 7B—The bridge stack is lifted up with the elevating platform HT. The bottom chords U of the first bridge segment B1 are held on the front-part carrier of the laying beam V. This erects the first bridge segment B1. The first and the second diagonal braces D1, D2 are locked and the forward supporting system ST is moved forward. The second supporting system ST2 for the vehicle provided on the vehicle rear is shown only schematically. It is used for stabilizing the vehicle and bringing the laying beam V into a horizontal position.

FIG. 7C—The remaining bridge stack is moved farther back with carriage S. In this case, the elevating platform HT can be lowered slightly so that the second bridge element 28 of the first bridge segment B1 can slide out more easily. The remaining bridge elements are lifted up slightly by means of the bridge stacking device BST. The first bridge segment B1 is now finished.

FIG. 7D—The remaining bridge stack is moved farther back with carriage S. The elevating platform HT is lowered. The bottom chord of the lower second bridge segment B2 is locked on carriage S. The elevating platform HT is again lifted up and the fourth diagonal brace D4 is locked.

FIG. 7E—The carriage with the remaining bridge stack is moved against the finished first bridge segment B1. In this case, the ramps R which are not needed are pushed over the bottom chord. The bridge floor and the bottom chord are connected.

FIG. 7F—The bottom chord U of the first bridge segment B1 on the laying beam V is released. The finished bridge segment B1 with the connected bridge segment B2 is slightly lifted up with the elevating platform HT, and the carriage S with the complete bridge is advanced.

Figures 7G, 7H, 7I, 7J:
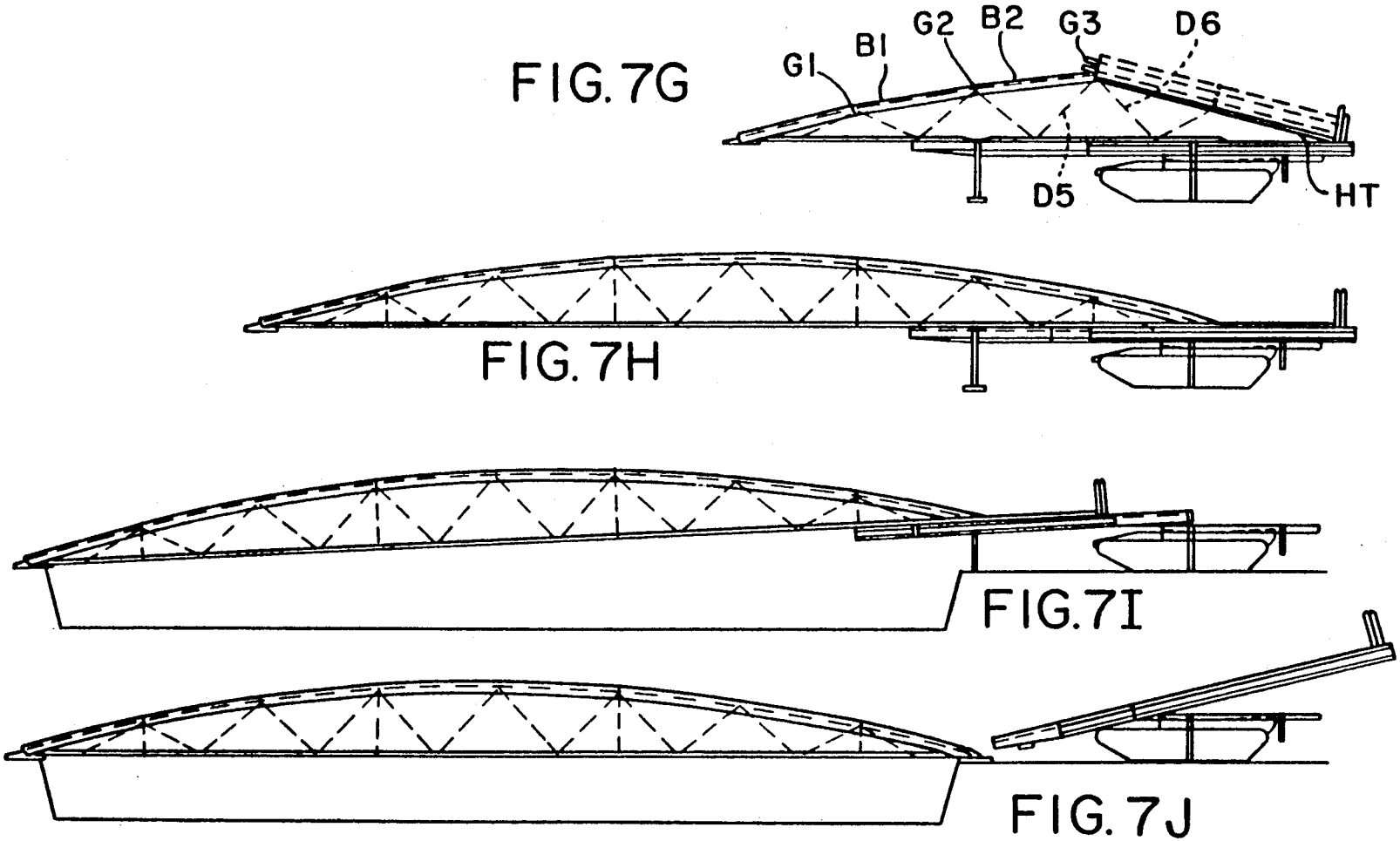

FIG. 7G—The bottom chord of the bridge segment B2 is held on the laying beam V and released on the carriage. The carriage S with the remaining bridge stack is moved back to the third bridge floor joint G3. The elevating platform HT is lifted up and the diagonal braces D5 and D6 are locked.

FIG. 7H—The operations are repeated with the two remaining bridge segments according to the sequence of FIGS. 7F, 7G and 7D until the whole bridge is erected. Then the complete bridge is slightly lifted by the elevating platform HT.

FIG. 7I—The bridge is advanced with the carriage S and deposited on the opposite embankment by lowering the elevating platform HT and the laying beam V.

FIG. 7J—The carriage S and laying beam V are moved back until the bridge just barely still rests on the laying beam V. The laying beam V is inclined to deposit the bridge on the embankment.

Figure 8:
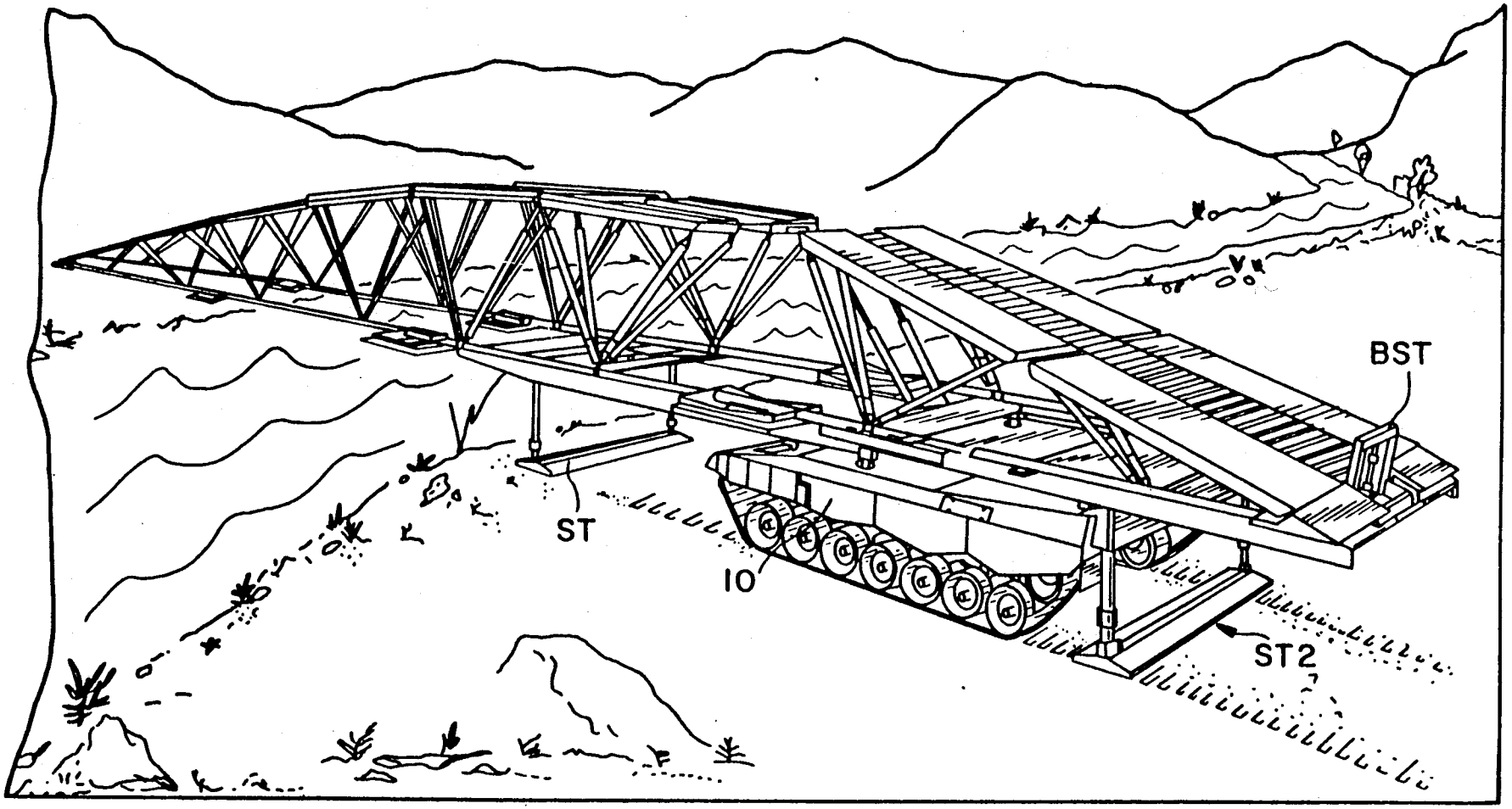
FIG. 8 is a perspective view of the laying operation.

FIG. 8 shows a scene of the laying of the forty meter bridge at the point in time of the connecting of the last bridge segment. This figure illustrates the frame-shaped construction of the laying beam V, the forward and rearward supporting system ST, ST2 for the vehicle 10 and the bridge stacking device BST.

In principle, any vehicle such as an armored vehicle or a vehicle with wheels, can be used as the laying vehicle if it can carry the minimum useful load of approximately twenty tons. The figures show the conditions for the known Leopard II tank vehicle. When laying the bridge or taking it up again, the vehicle must be able to compensate for the slopes of the embankment both longitudinally and transversely. The rear tank supporting system ST2 and the supporting system ST of the laying beam V are used for this purpose. The hydraulic cylinders, in this case arranged in pairs, act upon a common footplate. The vehicle is lifted out of its springs and is adjusted to be level. If a series-produced vehicle is modified as a laying vehicle, it must essentially be taken into account that the forces can be introduced into the structure by way of the four fixed points by the laying system and those of the rear vehicle supporting system. In FIG. 8, the first three bridge segments (consisting of the first six bridge elements) are completely mounted and locked by means of the holding device HB on the laying beam V. The elevating platform HT has set up the fourth segment. The carriage S advances for the connecting.

Because of the required laying speed and the large number of drives which must be operated on time and in a specific sequence with respect to one another (FIGS. 7A-7J) and because of the variety of bridge combinations, it is demonstrated that the control is best performed by means of a computer.

Figure 9:
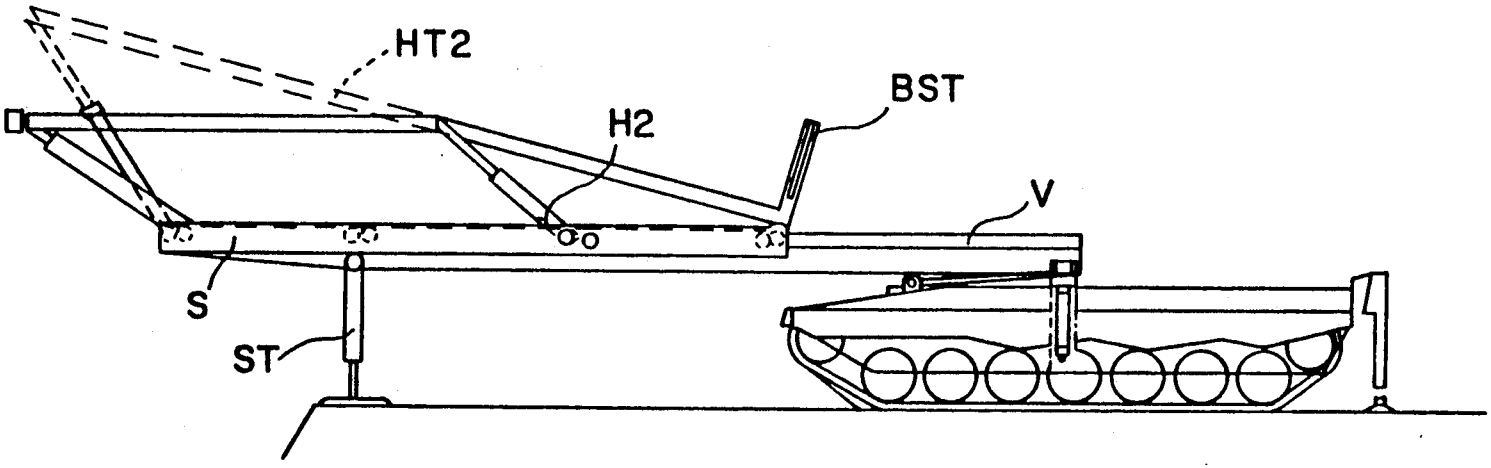
FIG. 9 is a side view of a laying device in the operating position.

FIG. 9 shows a further embodiment in which the elevating platform HT2, in addition to the fastening on the carriage S, has another horizontally extending axis of rotation by means of which the platform surface can be bent so that the forward part may extend, for example, horizontally or slightly downward, while the rearward part of the platform is erected upward. As a result, the pulling-out of bridge elements can be facilitated.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A laying device for constructing a bridge having connectable bridge elements, comprising:

a laying beam which is extendable and swivellable;

a carriage movably mounted on said laying beam and including a swivelling elevating platform on which the connectable bridge elements are disposed;

a first holding device provided on said laying beam for locking previously connected bridge elements;

a second holding device provided on said carriage for locking a next connectable bridge eklement to be laid;

wherein said carriage lifts and moves the whole constructed bridge off of said laying beam and wherein said elevating platform is swivelled with respect to said carriage around an axis in the rearward area of said platform and carriage.

2. A laying device according to claim 1, further comprising a supporting system being swivellable and extendable arranged on the laying beam.

3. A laying device according to claim 2, wherein said elevating platform includes a horiziontally extending joint such that, when said elevating platform is lifted up, its forward part is brought into a horizontal position.

4. A laying device according to claim 1, wherein said elevating platform includes a horizontally extending joint such that, when said elevating platform is lifted up, its forward part is brought into a horizontal position.

5. A laying device for constructing a bridge having connectabel bridge elements, comprising:

a laying beam which is extendable and swivellable;

a carriage movably mounted on said laying beam and including a swivelling elevating platform on which the connectable bridge eklements are disposed;

a first holding device provided on said laying beam for locking previously connected bridge elements;

a second holding device provided on said carriage for locking a next connectable bridge element to be laid;

wherein said carriage lifts and moves the whole constructed bridge off of said laying beam; and wherein said elevating platform includes a horizontally extending joint such that, when said elevating platform is lifted up, its forward part is brought into a horizontal position.

* * * * *